US012398881B2

(12) United States Patent
Chen

(10) Patent No.: US 12,398,881 B2
(45) Date of Patent: Aug. 26, 2025

(54) COMBUSTION DEVICE WITH HIGH COMBUSTION EFFICIENCY

(71) Applicant: Pro-Iroda Industries, Inc., Taichung (TW)

(72) Inventor: Wei-Long Chen, Taichung (TW)

(73) Assignee: PRO-IRODA INDUSTRIES, INC., Taichung (TW)

( * ) Notice: Subject to any disclaimer, the term of this patent is extended or adjusted under 35 U.S.C. 154(b) by 566 days.

(21) Appl. No.: 17/864,661

(22) Filed: Jul. 14, 2022

(65) Prior Publication Data

US 2023/0358399 A1 Nov. 9, 2023

(30) Foreign Application Priority Data

May 3, 2022 (TW) ..... 111116674

(51) Int. Cl.
*F23D 14/10* (2006.01)

(52) U.S. Cl.
CPC ..... *F23D 14/105* (2013.01); *F23D 2203/007* (2013.01)

(58) Field of Classification Search
CPC .. F23D 14/105; F23D 14/65; F23D 2203/007; F23L 1/00
USPC ..... 431/337
See application file for complete search history.

(56) References Cited

U.S. PATENT DOCUMENTS

| | | | | |
|---|---|---|---|---|
| 2,288,937 | A * | 7/1942 | Chambers | G05D 23/128 431/278 |
| 3,635,646 | A * | 1/1972 | Cox | F23D 14/36 431/89 |
| 5,222,476 | A * | 6/1993 | Chmielewski | F23C 6/04 126/110 C |
| 5,603,256 | A | 2/1997 | Charlson et al. | |
| 5,873,355 | A | 2/1999 | Schlosser et al. | |
| 9,609,982 | B2 * | 4/2017 | Padgett | F24C 3/087 |
| 2007/0054227 | A1 * | 3/2007 | Tada | F23D 14/22 431/181 |
| 2009/0126716 | A1 * | 5/2009 | Kuo | F23D 14/105 126/41 R |
| 2014/0272741 | A1 * | 9/2014 | Downing | F23D 14/10 431/280 |
| 2015/0285509 | A1 | 10/2015 | Wie et al. | |
| 2018/0087771 | A1 | 3/2018 | Huang et al. | |
| 2020/0340675 | A1 * | 10/2020 | Corbin | F23D 14/64 |

FOREIGN PATENT DOCUMENTS

| | | | |
|---|---|---|---|
| CN | 207797037 | U | 8/2018 |
| CN | 111657752 | A | 9/2020 |
| EP | 0685684 | A2 | 12/1995 |

(Continued)

*Primary Examiner* — Avinash A Savani
(74) *Attorney, Agent, or Firm* — MUNCY, GEISSLER, OLDS & LOWE, P.C.

(57) ABSTRACT extends lengthwise along a reference line. The mixing section includes a second air inlet extending therethrough in a direction transverse to the reference line. The mixing section has a first side and a second side on opposite sides and the second side is adjacent to a Y-axis of a coordinate system. The first mixing port extends on the second side. The outlet section has a straight part and a curved part along its length sequentially. The straight part extends between the mixing section and the curved part.

9 Claims, 6 Drawing Sheets
(1 of 6 Drawing Sheet(s) Filed in Color)

(56) References Cited

FOREIGN PATENT DOCUMENTS

| | | | |
|---|---|---|---|
| EP | 3730837 | A2 | 10/2020 |
| JP | S5473539 | U | 5/1979 |
| JP | S5474941 | U | 5/1979 |
| JP | S60105960 | U | 7/1985 |
| TW | 200728661 | A | 8/2007 |
| TW | I306498 | B | 2/2009 |
| TW | I311481 | B | 7/2009 |
| TW | 201236624 | A1 | 9/2012 |
| TW | I691682 | B | 4/2020 |

* cited by examiner

COMBUSTION DEVICE WITH HIGH COMBUSTION EFFICIENCY

BACKGROUND OF THE INVENTION

1. Field of the Invention

The present invention relates to a combustion device and, particularly, to a combustion device with high combustion efficiency.

2. Description of the Related Art

TW U.S. Pat. No. 1,306,498 discloses a burner tube of a gas combustion device. The burner tube has a first end as an inlet for gas and a second end. The burner tube has several small holes for flames to pass and several air inlet apertures for outside air to enter. The air inlet apertures have larger diameters than the small holes.

Further, FIG. 6 is a partial enlarged cross-sectional view of a conventional burner tube, particularly, a burner tube used in the set forth patent. The burner tube 90 has air inlet apertures in the middle and rear sections and is provided with a main air hole 91 for air. The main air hole 91 is located on the lower side of the burner tube 90 so as to prevent liquids produced during a roasting process from dripping into the air burner tube 90. However, such configuration of the main air hole 91 causes the gas flow rate to decrease rapidly along a curved portion of the burner tube 90, which in turn affects the effect of air intake by the burner tube 90 and will thus decrease the combustion efficiency of the burner tube 90.

The present invention is, therefore, intended to obviate or at least alleviate the problems encountered in the prior art.

SUMMARY OF THE INVENTION

According to the present invention, a combustion device with high combustion efficiency includes a body and a burner tube arranged in the body. The burner tube extends lengthwise on a plane and has a mixing section in which gas and air are mixed and an outlet section in which a combustible mixture of the gas and the air is discharged along its length. The mixing section has an inlet for gas at a first end thereof and extends lengthwise along a reference line. The mixing section includes a first mixing port for admitting air extending therethrough in a direction transverse to the reference line. The mixing section has a first side and a second side on opposite sides and the second side is adjacent to a Y-axis of a coordinate system. The first mixing port extends on the second side. The mixing section forms a structure of a nozzle configured to accelerate the flow speed of the combustible mixture of the gas and the air. The structure of the nozzle extends lengthwise along the reference line. The structure of the nozzle has a first end, a second end, and a middle between the first and the second ends, wherein the structure of the nozzle has a decreasing width as it extends lengthwise from the first end to the middle and an increasing width as it extends lengthwise from the middle to the second end, wherein the mixing section forms a structure of a chamber which delimits the inlet and the first mixing port is disposed on the structure of the chamber. The outlet section has a straight part and a first curved part along its length sequentially. The straight part extends axially along the reference line. The straight part extends between the mixing section and the first curved part.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
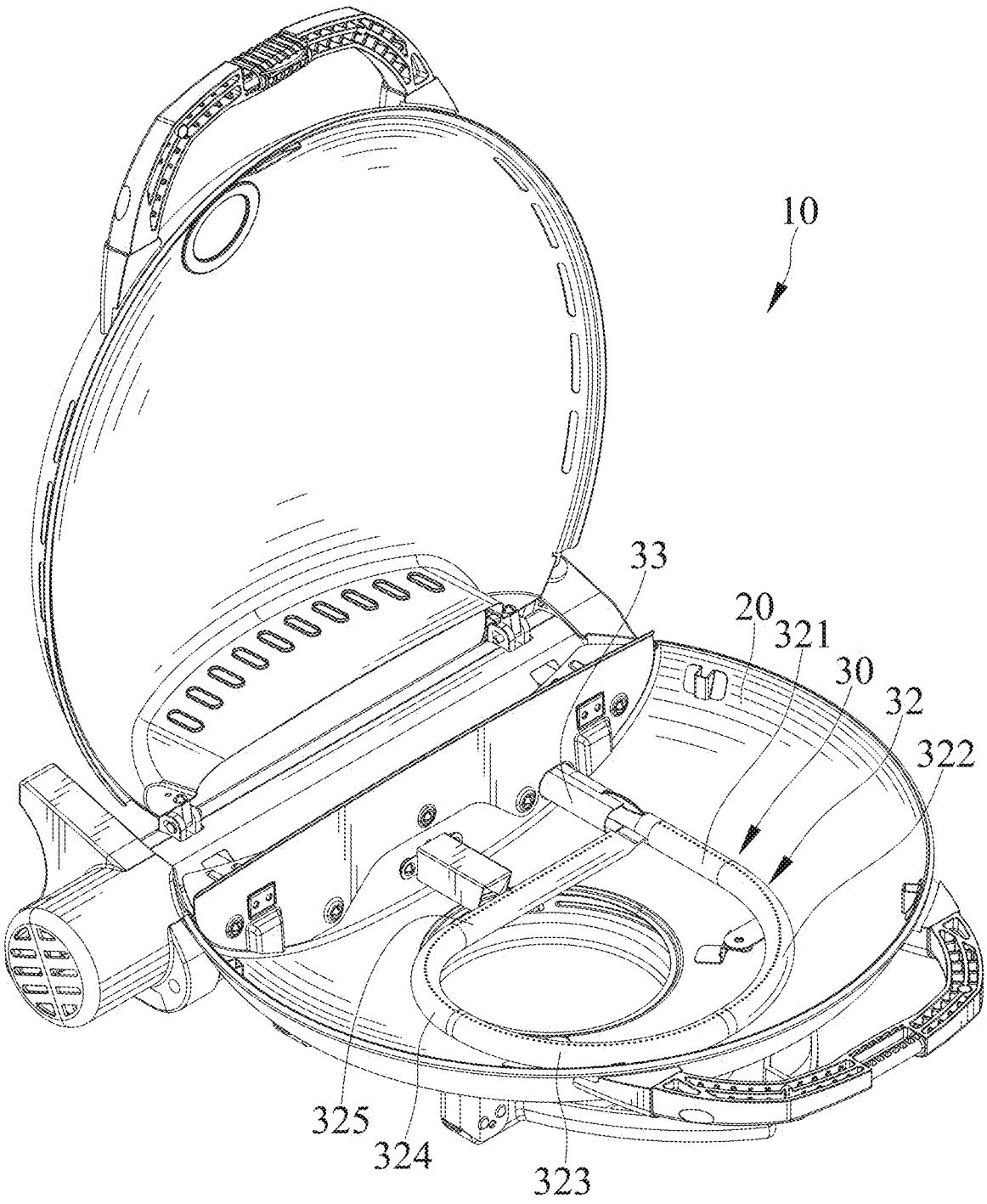
FIG. 1 is a perspective view of a combustion device with high combustion efficiency in accordance with the present invention.
Figure 2:
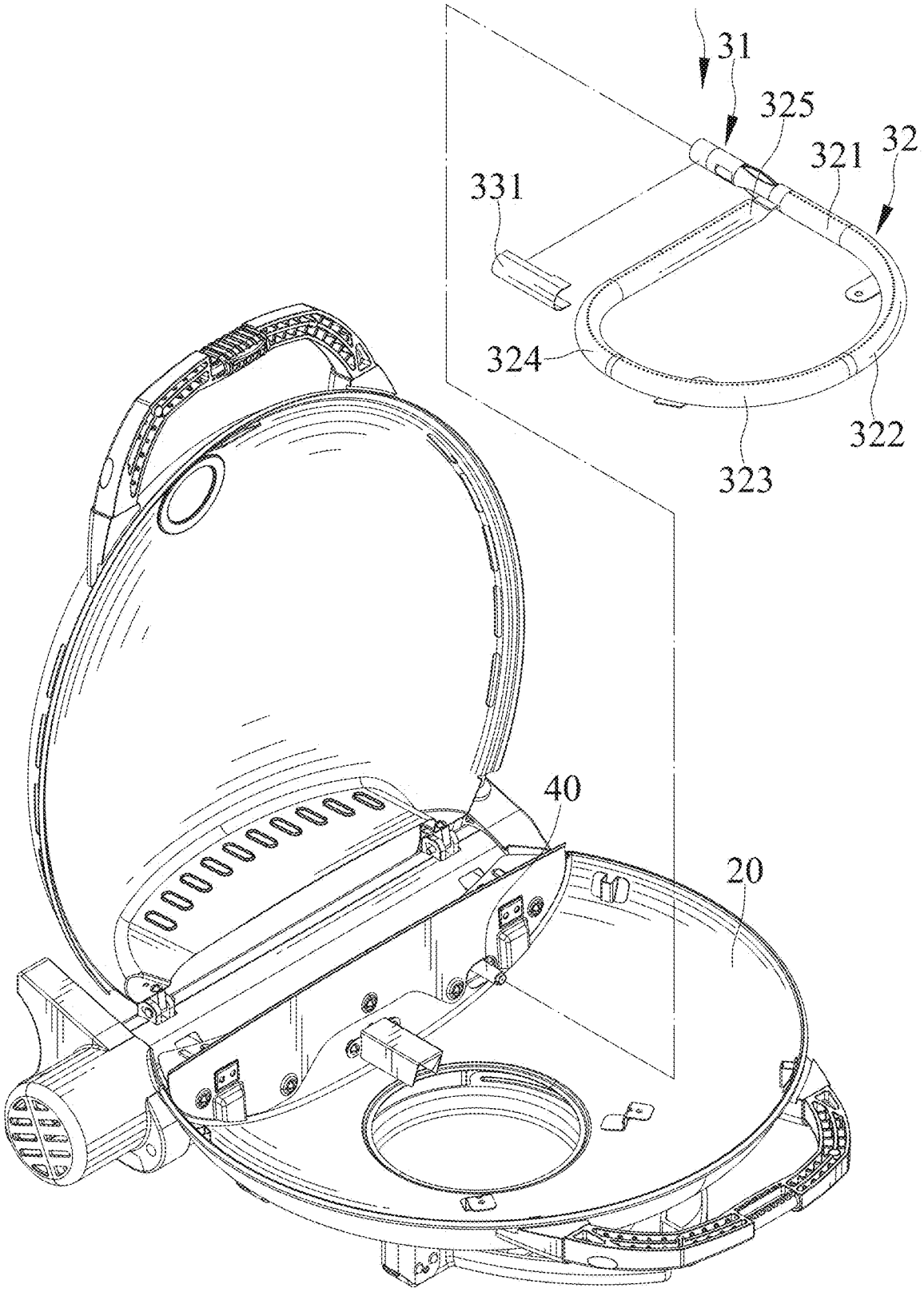
FIG. 2 is an exploded perspective view of the combustion device of FIG. 1.
Figure 3:
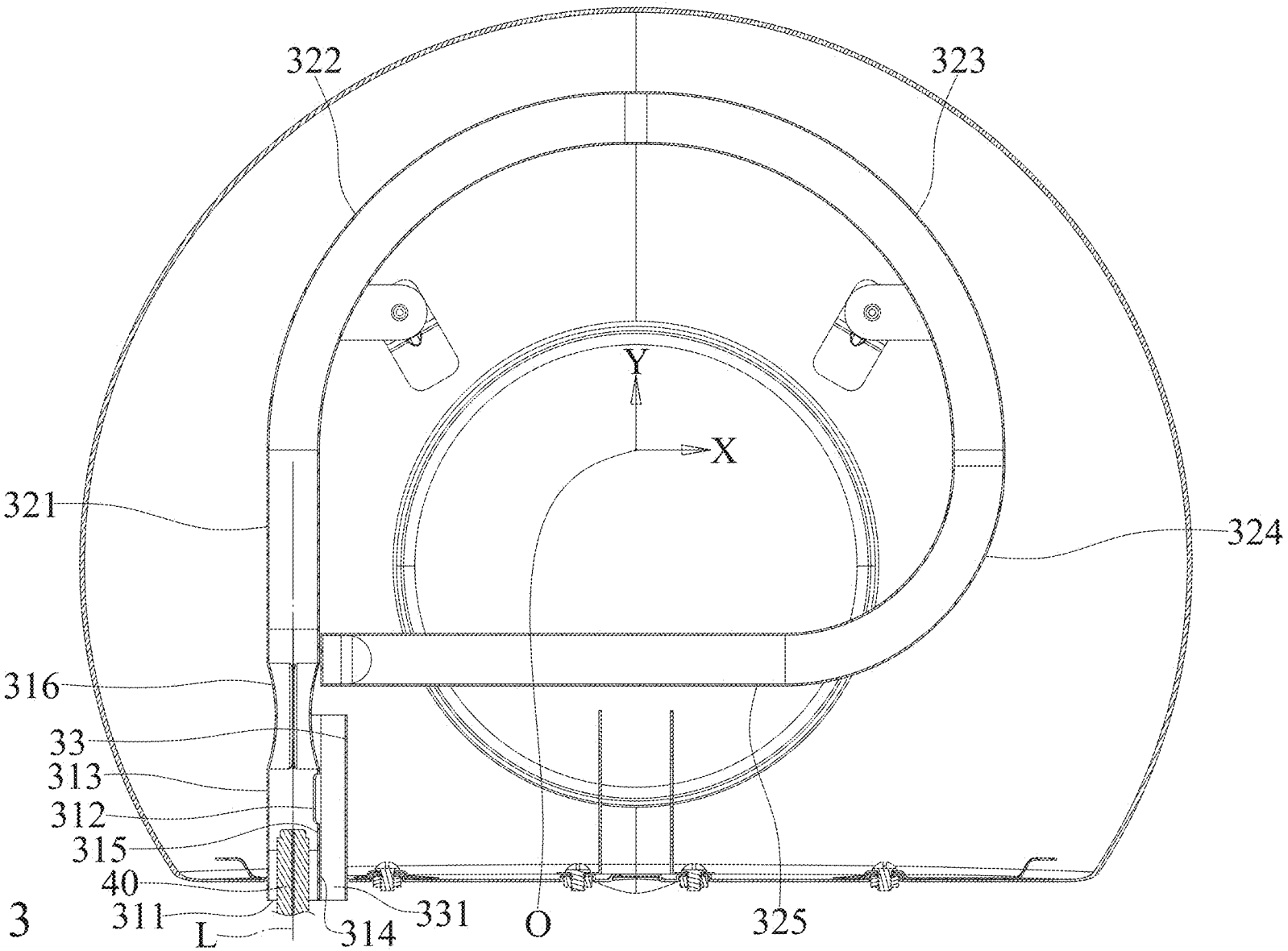
FIG. 3 is a cross-sectional view of the combustion device of FIG. 1.

Refer to FIGS. 1 through 5, a combustion device 10 with high combustion efficiency in accordance with the present invention includes a body 20, a burner tube 30 arranged in the body 20 and connected to an outlet of a gas supply tube 40, and a cover 33 coupled to the burner tube 30.

The burner tube 30 extends lengthwise on a plane and has a mixing section 31 in which gas and air are mixed and an outlet section 32 in which a combustible mixture of the gas and the air is discharged along its length.

The mixing section 31 has a first air inlet 311 for air at a first end thereof and extends lengthwise along a reference line L. The mixing section 31 forms a structure of a chamber which delimits the first air inlet 311. The first air inlet 311 into which an end of the gas supply tube 40 is inserted. The first air inlet 311 protrudes outside the body 20. The mixing section 31 includes a second air inlet 312 for admitting air. The second air inlet 312 is disposed on the structure of the chamber. The mixing section 31 has a first side 313 and a second side 314 on opposite sides and the second side 314 is adjacent to a Y-axis of a coordinate system. The second air inlet 312 extends on the second side 314 and through the mixing section 31 in a direction transverse to the reference line L. Moreover, the mixing section 31 has a second mixing port 315 separating an inner periphery of the mixing section 31 and an outer periphery of the gas supply tube 40. The second mixing port 315 has a second end being open. Further, the mixing section 31 forms a structure of a venturi tube 316 configured to accelerate the flow speed of the combustible mixture of the gas and the air. The structure of the venturi tube 316 extends lengthwise along the reference line L. The structure of the venturi tube 316 has a first end, a second end, and a middle between the first and the second ends. The structure of the venturi tube 316 has a decreasing width as it extends lengthwise from the first end to the middle and an increasing width as it extends lengthwise from the middle to the second end.

The cover 33 has a first side and a second side respectively connected an upper side and a lower side of the mixing section 31. The upper and the lower sides of the mixing section 31 face oppositely in a vertical direction and extend between the first and the second sides 313 and 314 of the mixing section 31. The cover 33 is disposed in a spaced manner above the second air inlet 312 to mask but not closing the second air inlet 312. Therefore, the second air inlet 312 is out of sight. Further, the cover 33 and the second side 314 of the mixing section 31 face oppositely and delimit an air passage 331 therebetween for allowing outside air to flow into the mixing section 31 through the second air inlet 312. The cover 33 extends lengthwise from a first end disposed inside the body 20 to a second end disposed outside the body 20. The second end of the air passage 331 is in a form of an open end. Additionally, the first end of the air passage 331 is in a form of an open end.

Figure 4:
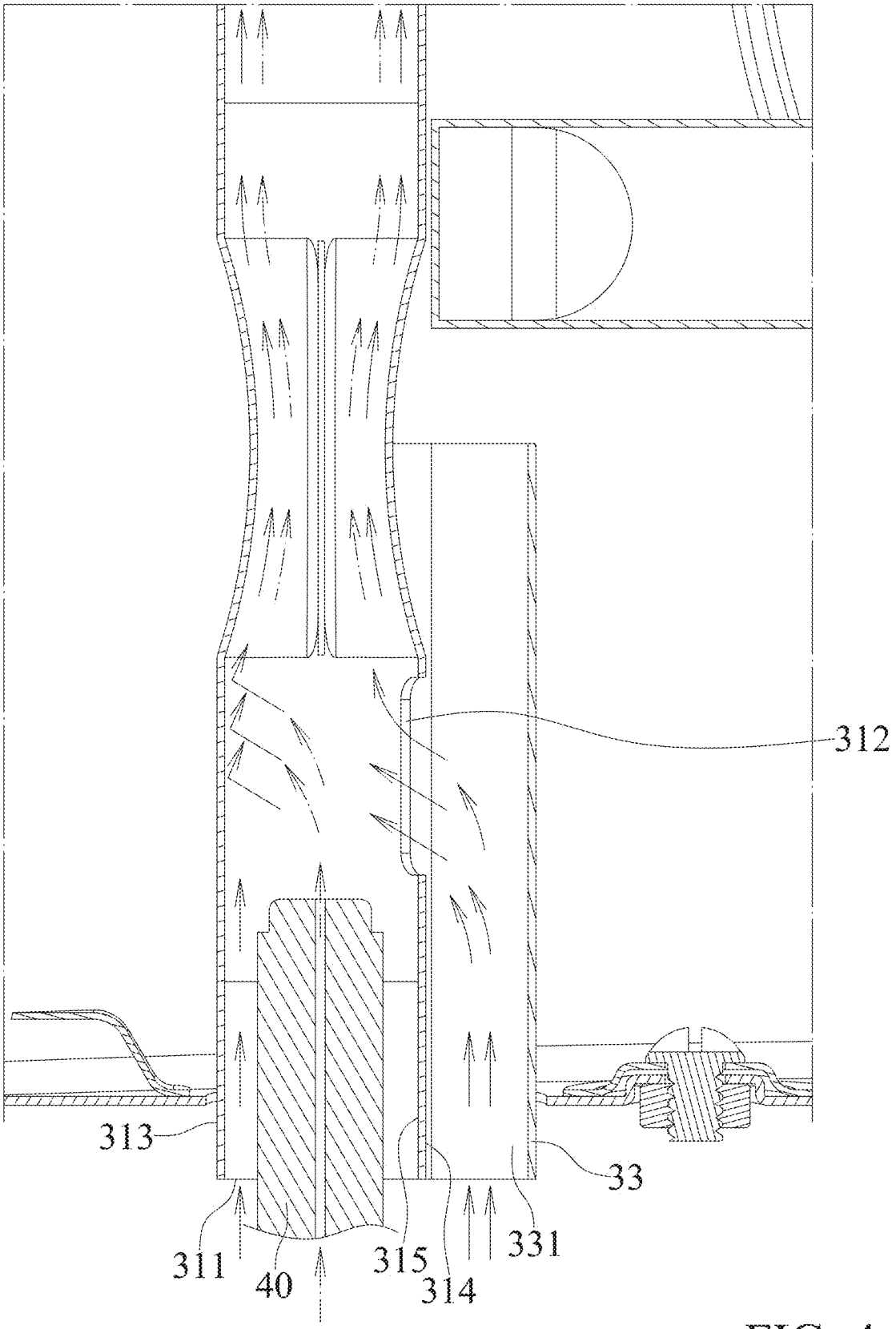
FIG. 4 is a partial, enlarged view of FIG. 3, with line-dot arrow indicating gas and line arrow indicating air.

The outlet section 32 has a first straight part 321 and a first curved part 322 along its length sequentially. The first straight part 321 extends axially along the reference line L. The first straight part 321 extends between the mixing section 31 and the first curved part 322. The first straight part 321 has a first end adjacent and opening to the second end of the structure of the venturi tube 316. The coordinate system includes an X-axis perpendicular to the Y-axis and has an origin O at which the X and the Y axes intersect. The origin O and a center of curvature of the first curved part 322 are at a same side of the first curved part 322 which is adjacent to the origin O. Moreover, the outlet section 32 has a second curved part 323 and the first and the second curved parts 322 and 323 extend sequentially along the length of the outlet section 32. The second curved part 323 extends from a first end adjacent and opening to the first curved part 322 to a second end. The first and the second curved parts 322 and 323 extend in different quadrants of the coordinate system. The origin O and a center of curvature of the second curved part 323 are at a same side of the second curved part 323 which is adjacent to the origin O. Moreover, the outlet section 32 has a third curved part 324 and the second and the third curved parts 323 and 324 extend sequentially along the length of the outlet section 32. The third curved part 324 extends from a first end adjacent and opening to the second curved part 323 to a second end. The third curved part 324 lies in different quadrants of the coordinate system from the first and the second curved parts 322 and 323. The first, the second, and the third curved part 322, 323, and 324 have first, second, and third radius of curvatures respectively and the third radius of curvature is smaller than the first and the second curvatures. Moreover, the outlet section 32 has a second straight part 325 and the third curved and the second straight parts 324 and 325 extend sequentially along the length of the outlet section 32. The second straight part 325 extends toward the first straight part 321. The second straight part 325 extends in a direction transverse to the reference line L. The second straight part 325 extends from a first end adjacent and opening to the third curved part 324 to a second end which is closed. 2 FIG. 4 shows gas in the gas supply tube 40 flowing into the mixing section 31 and the first air inlet 311 of the burner tube 30 allows entrance of the gas. The first air inlet 311 allows entrance of air and the gas is mixed with air in the second mixing port 315 a first time. Then, the flow rate of the gas can create negative pressure in the mixing section 31. Thus, air is induced and passes through the second air inlet 312 for mixing with the gas, and the gas is mixed with air a second time. The gas is mixed with air at a second time by air enters the second air inlet 312. Further, the air flowing through the second air inlet 312 come from the air passage 331. As set forth, the air passage 331 allows the air to flow therein and guides the air into the mixing section 31 through the second air inlet 312. Then, a combustible mixture of the air and the gas flows to the venturi tube 316 prior to the straight part 321.

Figure 5:
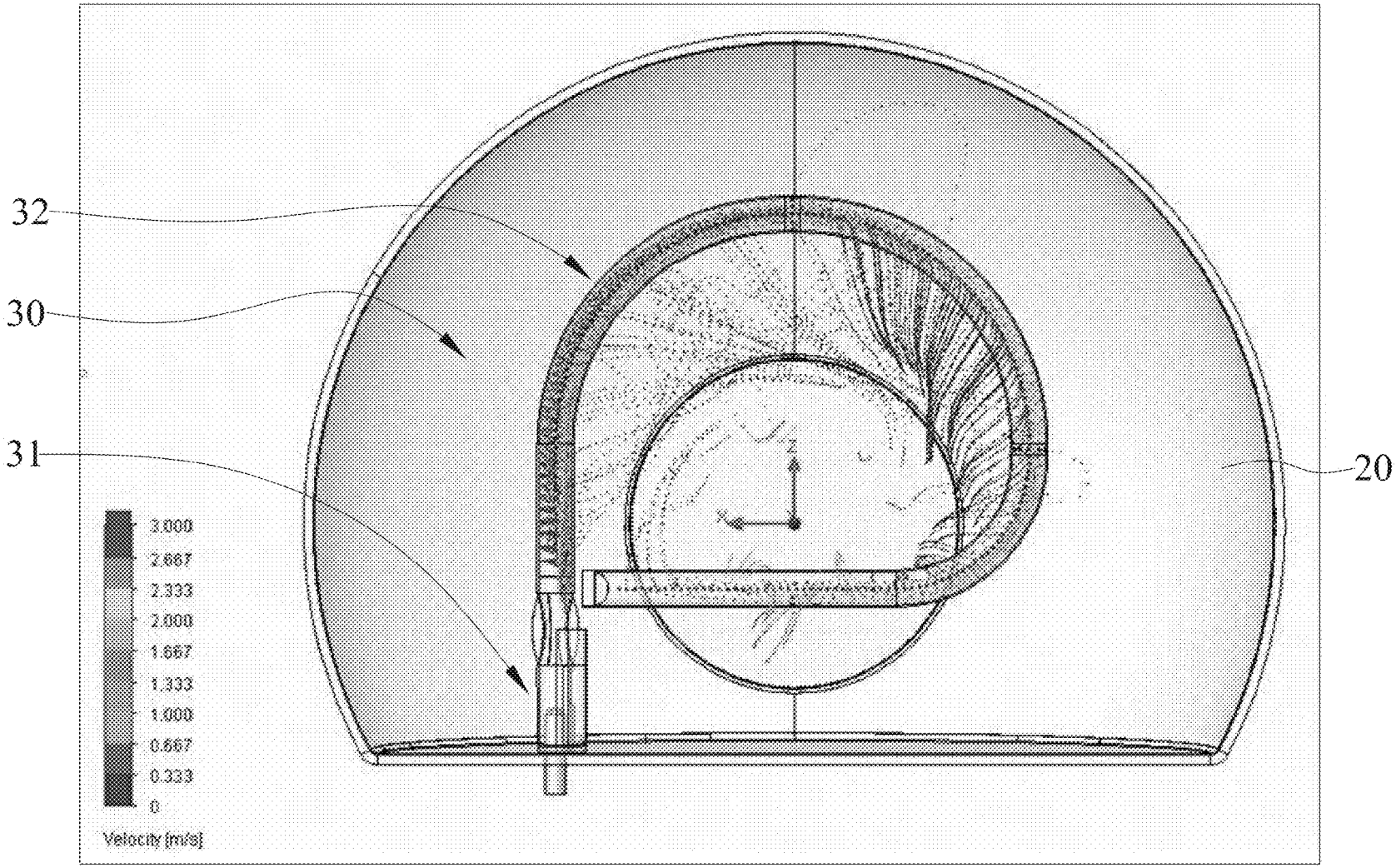
FIG. 5 is a software simulation of a combustible mixture of the air and the gas in a burner tube of the combustion device of FIG. 1.
Figure 6:
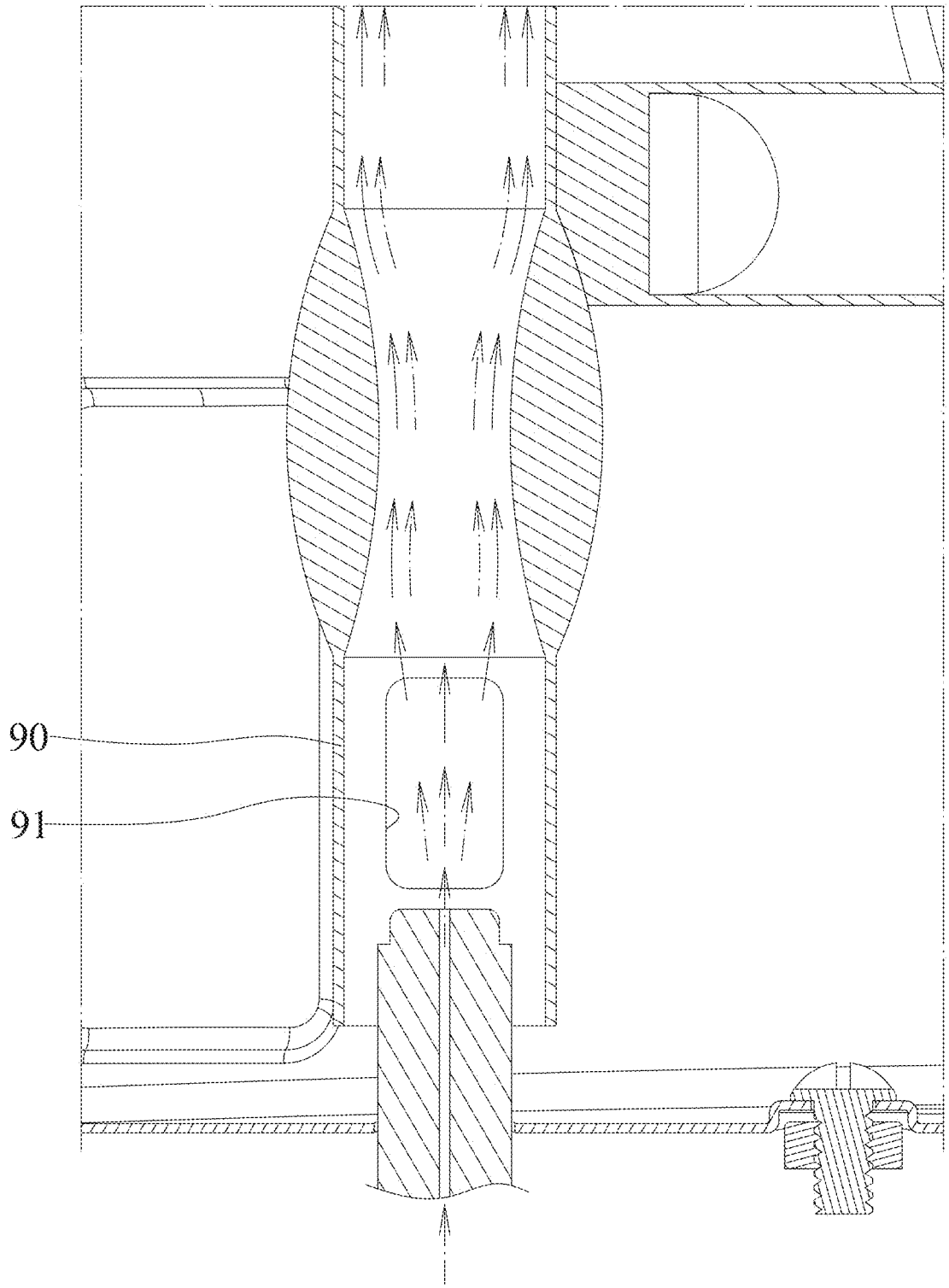
FIG. 6 is a cross-sectional view of a burner tube of a conventional burner, with line dot arrow indicating gas and line arrow indicating air.

In view of the foregoing, since the opening direction of the second air inlet 312 and the bending direction of the first curved part 322 face the same side of the mixing section 31, the combustible mixture of the air and the gas can smoothly flow in the first curved part 322. Additionally, since the air flowing through the second air inlet 312 into the mixing section 31 flows transversely to the gas, the speed of the combustible mixture of the gas and the air in the burner tube 30 is not greatly lowered, as shown in FIG. 5. Further, the shape of the first curved part 322 can reduce the speed loss of the combustible mixture of the air and the gas flowing in the burner tube 30, and can prevent the initial velocity of the gas in the mixing section 31 from being degraded whereby the mixing section 31 can introduce more air to improve combustion efficiency.

The foregoing is merely illustrative of the principles of this invention and various modifications can be made by those skilled in the art without departing from the scope and spirit of the invention.

What is claimed is:

1. A combustion device with high combustion efficiency comprising:

a body; and a burner tube arranged in the body, wherein the burner tube extends lengthwise on a plane and has a mixing section in which gas and air are mixed and an outlet section in which a combustible mixture of air and gas are discharged along its length, wherein the mixing section has a first air inlet for air at a first end thereof and extends lengthwise along a reference line, wherein the mixing section includes a second air inlet for admitting air extending therethrough in a direction transverse to the reference line, wherein the mixing section has a first side and a second side on opposite sides and the second side is adjacent to a Y-axis of a coordinate system, wherein the second air inlet extends on the second side, wherein the mixing section forms a structure of a venturi tube configured to accelerate the flow speed of the combustible mixture of air and gas, wherein the structure of the venturi tube extends lengthwise along the reference line, wherein the structure of the venturi tube has a first end, a second end, and a middle between the first and the second ends, wherein the structure of the venturi tube has a decreasing width as it extends lengthwise from the first end to the middle and an increasing width as it extends lengthwise from the middle to the second end, wherein the mixing section forms a structure of a chamber which delimits the first air inlet and the second air inlet is disposed on the structure of the chamber, wherein the outlet section has a first straight part and a first curved part along its length sequentially, wherein the first straight part extends axially along the reference line, and wherein the first straight part extends between the mixing section and the first curved part;

wherein since the opening direction of the second air inlet and the bending direction of the first curved part face the same side of the mixing section, the combustible mixture of the gas and the air can smoothly flow in the first curved part; and wherein since the air flowing through the second air inlet into the mixing section flows transversely to the gas, the speed of the combustible mixture of the gas and the air in the burner tube is not greatly lowered; and wherein the first curved part can reduce the speed loss of the combustible mixture of the air and the gas flowing in the burner tube, and can prevent the initial velocity of the gas in the mixing section from being degraded whereby the mixing section can introduce more air to improve combustion efficiency; and wherein the burner tube has a cover coupled thereto with a first side and a second side respectively connected an upper side and a lower side of the mixing section, wherein the upper and the lower sides of the mixing section face oppositely in a vertical direction and extend between the first and the second sides of the mixing section, and wherein the cover is disposed in a spaced manner above the second air inlet to mask but not closing the second air inlet.

2. A combustion device with high combustion efficiency comprising:

a body; and a burner tube arranged in the body, wherein the burner tube extends lengthwise on a plane and has a mixing section in which gas and air are mixed and an outlet section in which a combustible mixture of air and gas are discharged along its length, wherein the mixing section has a first air inlet for air at a first end thereof and extends lengthwise along a reference line, wherein the mixing section includes a second air inlet for admitting air extending therethrough in a direction transverse to the reference line, wherein the mixing section has a first side and a second side on opposite sides and the second side is adjacent to a Y-axis of a coordinate system, wherein the second air inlet extends on the second side, wherein the mixing section forms a structure of a venturi tube configured to accelerate the flow speed of the combustible mixture of air and gas, wherein the structure of the venturi tube extends lengthwise along the reference line, wherein the structure of the venturi tube has a first end, a second end, and a middle between the first and the second ends, wherein the structure of the venturi tube has a decreasing width as it extends lengthwise from the first end to the middle and an increasing width as it extends lengthwise from the middle to the second end, wherein the mixing section forms a structure of a chamber which delimits the first air inlet and the second air inlet is disposed on the structure of the chamber, wherein the outlet section has a first straight part and a first curved part along its length sequentially, wherein the first straight part extends axially along the reference line, and wherein the first straight part extends between the mixing section and the first curved part;

wherein since the opening direction of the second air inlet and the bending direction of the first curved part face the same side of the mixing section, the combustible mixture of the gas and the air can smoothly flow in the first curved part; and wherein since the air flowing through the second air inlet into the mixing section flows transversely to the gas, the speed of the combustible mixture of the gas and the air in the burner tube is not greatly lowered; and wherein the first curved part can reduce the speed loss of the combustible mixture of the air and the gas flowing in the burner tube, and can prevent the initial velocity of the gas in the mixing section from being degraded whereby the mixing section can introduce more air to improve combustion efficiency; and wherein the burner tube is connected to an outlet of a gas supply tube, wherein the gas supply tube has a first end inserted into the first air inlet of the mixing section, wherein the mixing section has a second mixing port separating an inner periphery of the mixing section and an outer periphery of the gas supply tube, and wherein the second mixing port has a second end being open; and wherein the burner tube has a cover coupled thereto with a first side and a second side respectively connected an upper side and a lower side of the mixing section, wherein the upper and the lower sides of the mixing section face oppositely in a vertical direction and extend between the first and the second sides of the mixing section, and wherein the cover is disposed in a spaced manner above the second air inlet to mask but not closing the second air inlet.

3. The combustion device as claimed in claim 1, wherein the first air inlet protrudes outside the body, wherein the cover extends lengthwise from a first end protruding inside the body to a second end protruding outside the body, wherein the cover and the second side of the mixing section face oppositely and delimit an air passage therebetween, and wherein the second end of the air passage is in a form of an open end.

4. The combustion device as claimed in claim 2, wherein the first air inlet protrudes outside the body, wherein the cover extends lengthwise from a first end protruding inside the body to a second end protruding outside the body, wherein the cover and the second side of the mixing section face oppositely and delimit an air passage therebetween, and wherein the second end of the air passage is in a form of an open end.

5. A combustion device with high combustion efficiency comprising:

a body; and a burner tube arranged in the body, wherein the burner tube extends lengthwise on a plane and has a mixing section in which gas and air are mixed and an outlet section in which a combustible mixture of air and gas are discharged along its length, wherein the mixing section has a first air inlet for air at a first end thereof and extends lengthwise along a reference line, wherein the mixing section includes a second air inlet for admitting air extending therethrough in a direction transverse to the reference line, wherein the mixing section has a first side and a second side on opposite sides and the second side is adjacent to a Y-axis of a coordinate system, wherein the second air inlet extends on the second side, wherein the mixing section forms a structure of a venturi tube configured to accelerate the flow speed of the combustible mixture of air and gas, wherein the structure of the venturi tube extends lengthwise along the reference line, wherein the structure of the venturi tube has a first end, a second end, and a middle between the first and the second ends, wherein the structure of the venturi tube has a decreasing width as it extends lengthwise from the first end to the middle and an increasing width as it extends lengthwise from the middle to the second end, wherein the mixing section forms a structure of a chamber which delimits the first air inlet and the second air inlet is disposed on the structure of the chamber, wherein the outlet section has a first straight part and a first curved part along its length sequentially, wherein the first straight part extends axially along the reference line, and wherein the first straight part extends between the mixing section and the first curved part;

wherein since the opening direction of the second air inlet and the bending direction of the first curved part face the same side of the mixing section, the combustible mixture of the gas and the air can smoothly flow in the first curved part; and wherein since the air flowing through the second air inlet into the mixing section flows transversely to the gas, the speed of the combustible mixture of the gas and the air in the burner tube is not greatly lowered; and wherein the first curved part can reduce the speed loss of the combustible mixture of the air and the gas flowing in the burner tube, and can prevent the initial velocity of the gas in the mixing section from being degraded whereby the mixing section can introduce more air to improve combustion efficiency; and wherein the coordinate system includes an X-axis perpendicular to the Y-axis and has an origin at which the X and the Y axes intersect, wherein the origin and a center of curvature of the first curved part are at a same side of the first curved part which is adjacent to the origin, wherein the outlet section has a second curved part and the first and the second curved parts extend sequentially along the length of the outlet section, wherein the second curved part extends from a first end adjacent and opening to the first curved part to a second end, wherein the first and the second curved parts extend in different quadrants of the coordinate system, and wherein the origin and a center of curvature of the second curved part are at a same side of the second curved part which is adjacent to the origin; and wherein the outlet section has a third curved part and the second and the third curved parts extend sequentially along the length of the outlet section, wherein the third curved part extends from a first end adjacent and opening to the second curved part to a second end, wherein the third curved part lies in different quadrants of the coordinate system from the first and the second curved parts, and wherein the first, the second, and the third curved part have first, second, and third radius of curvatures respectively and the third radius of curvature is smaller than the first and the second curvatures.

6. The combustion device as claimed in claim 5, wherein the outlet section has a second straight part and the third curved and the second straight parts extend sequentially along the length of the outlet section, wherein the second straight part extends toward the first straight part, wherein the second straight part extends from a first end adjacent and opening to the third curved part to a second end which is closed.

7. The combustion device as claimed in claim 3, wherein the first end of the air passage is in a form of an open end.

8. The combustion device as claimed in claim 4, wherein the first end of the air passage is in a form of an open end.

9. The combustion device as claimed in claim 1, wherein the burner tube is connected to an outlet of a gas supply tube, wherein the gas supply tube has a first end inserted into the first air inlet of the mixing section, wherein the mixing section has a second mixing port separating an inner periphery of the mixing section and an outer periphery of the gas supply tube, and wherein the second mixing port has a second end being open.

* * * * *